US005839582A

United States Patent [19]

Strong et al.

[11] Patent Number: 5,839,582

[45] Date of Patent: Nov. 24, 1998

[54] SELF VACUUM STORAGE BAG

[76] Inventors: William P. Strong, 2244 Bard Ct., Cocoa, Fla. 32926; Robert P. Mueller, 3596 S. Atlantic Ave., Cocoa Beach, Fla. 32931

[21] Appl. No.: 513

[22] Filed: Dec. 30, 1997

[51] Int. Cl.[6] ..... B65D 81/20

[52] U.S. Cl. ..... 206/524.8; 206/522; 383/40; 383/61; 383/63; 383/39

[58] Field of Search ..... 206/522, 524.8, 206/221; 383/63, 61, 38, 40, 100, 103, 101

[56] References Cited

U.S. PATENT DOCUMENTS

| | | | |
|---|---|---|---|
| 2,874,830 | 2/1959 | Birmingham, Jr. | 206/47 |
| 3,077,262 | 2/1963 | Gaste | 206/47 |
| 3,367,785 | 2/1968 | Finucane et al. | 99/171 |
| 3,565,147 | 2/1971 | Ausnit | 150/3 |
| 3,958,693 | 5/1976 | Greene | 206/455 |
| 4,098,404 | 7/1978 | Markert | 206/525 |
| 4,186,786 | 2/1980 | Kirkpatrick | 150/3 |
| 4,295,566 | 10/1981 | Vincek | 206/457 |
| 4,576,283 | 3/1986 | Fafournoux | 206/524.8 |
| 4,702,376 | 10/1987 | Pagliaro | 206/524.8 |
| 4,756,629 | 7/1988 | Tilman et al. | 383/63 |
| 5,203,458 | 4/1993 | Cornwell | 206/524.8 |
| 5,240,112 | 8/1993 | Newburger | 206/524.8 |
| 5,480,030 | 1/1996 | Sweeney et al. | 206/524.8 |
| 5,544,752 | 8/1996 | Cox | 206/524.8 |

*Primary Examiner*—Paul T. Sewell
*Assistant Examiner*—Trinh Nguyen

[57] ABSTRACT

A pumping system that is incorporated into and made part of a flexible air tight bag of the interlocking seal variety. Currently, the practice is to squeeze the storage compartment of the bag to force out as much air as possible and then sealing the bag. The improved method provides a means of pumping out air and other gases after the bag is sealed. This method results in a more complete elimination of air and other gases in the storage compartment of the bag.

1 Claim, 2 Drawing Sheets

SELF VACUUM STORAGE BAG

BACKGROUND OF THE INVENTION

This invention relates to an improved method of extracting air from flexible type bags of the air-tight sealing variety which are commonly used for food storage. The extraction of air and other gases can help preserve the quality and shelf life of many food products.

U.S. Pat. No. 4,532,652 to Herrington has a prior art which incorporates a one-way valve into a flexible plastic type bag. This invention, however, only permits the exiting of air when the storage area of the bag is compressed. It is not capable of extraction/suction.

We are unaware of any prior method in which air can be extracted which is self contained within the bag.

BRIEF SUMMARY OF THE INVENTION

This invention relates to a pump system that is incorporated into and made part of a flexible bag of the air tight interlocking seal variety for the purpose of extracting air and other gases from the storage compartment of the bag. This pump system is incorporated as part of the bag during the manufacturing process. Removal of air and other gases from many food products, preserves freshness and increases shelf life. In addition to food, there are numerous other products that require an environment in which air and other gases are reduced. There are a variety of effective vacuum systems for storage bags that require an apparatus independent of the bag. Our invention, however, is the only one which incorporates an extraction method as part of the bag.

Figure 1:
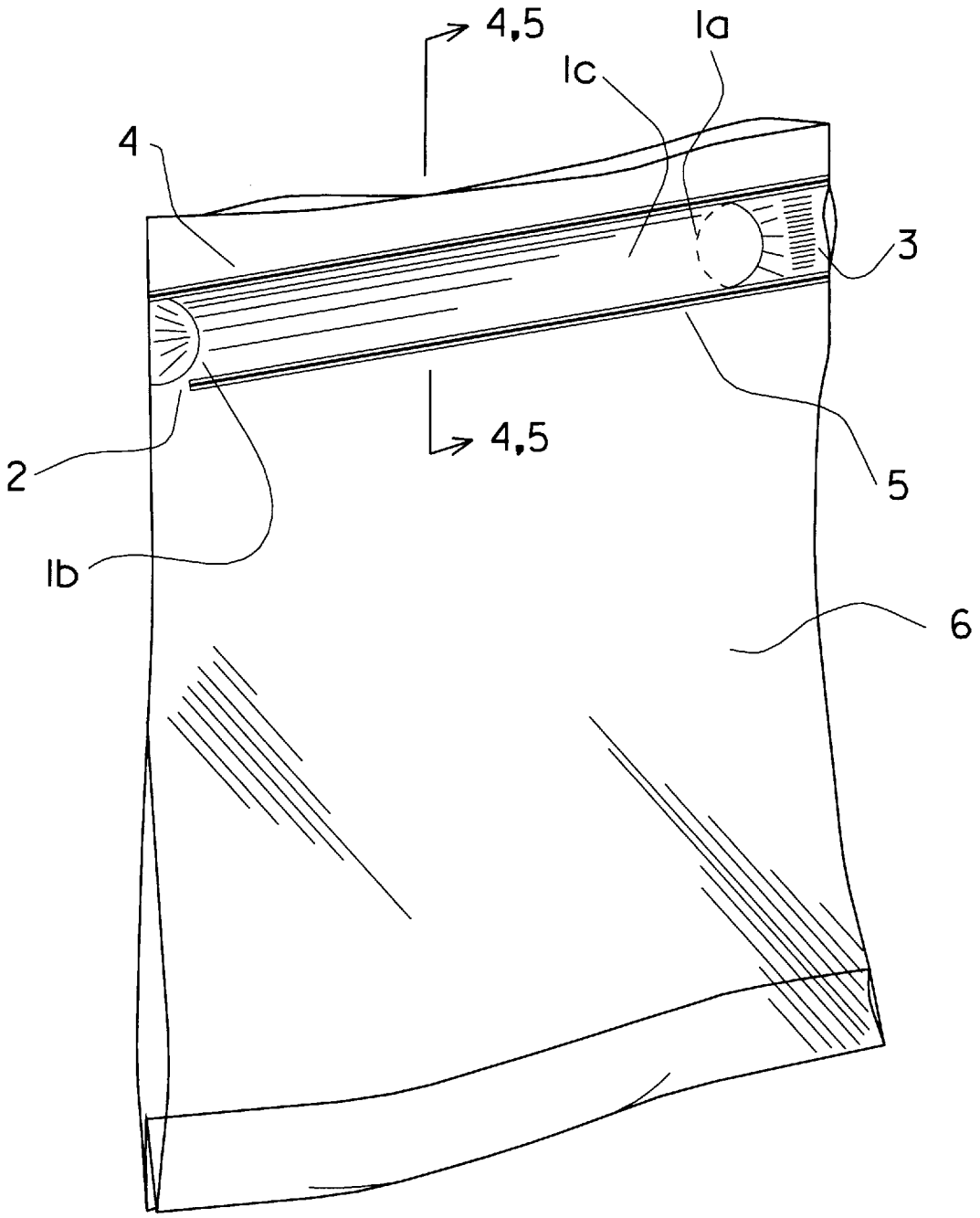
FIG 1. shows a perspective general view of the pump incorporated into a flexible bag.

Number 6 shows the storage compartment of the bag in FIG. 1.

DETAILED DESCRIPTION OF THE INVENTION

FIG. 1. shows a frontal view of a air tight flexible type bag and a pump system which is integrated into and made part of said bag and which is located close to opening end of the bag. The parts and operation are describes as follows: The pump chamber sleeve 1*a* and 1*b* which is tapered at each end and at least one of which is made of a plastic or other flexible material capable of returning to its original outward bow shape (or other similar shape) after being compressed. The suction port 2 which is a permanent opening in the bottom interlocking air tight seal 5 at one end of the bag through which air and other gases are extracted from the storage compartment 6. The one-way valve 3 which is made of plastic or other material capable of remaining in the closed position except when the pump chamber is compressed pushing air and other gases out through one-way valve 3. One-way valve 3 is located at the end opposite suction port 2 between the upper 4 and lower 5 interlocking air tight seals. Upper seal 4 and lower seal 5 which are parallel and air tight when close, with the exception of suction port 2, creates the pump chamber 1*c* when the interlocking seals are closed. In the case of a standard household food storage bags the pump can be activated by simply compressing the pump chamber sleeve 1*a* and 1*b* located between the upper seal 4 and lower seal 5 with the thumb and index fingers and holding the compression as the fingers are drawn towards the one-way valve 3 pushing air and other gases out. As the fingers move along towards the one-way valve the pump chamber sleeve returns to the outward bow position creating additional extraction through suction port 2. This pumping procedure should be repeated until the desired result is accomplished. The same result can be accomplished by placing the seals on a flat surface and activating the pump chamber sleeve with a finger, the palm of the hand or a household item. Flexible bags in which the pump chamber sleeve is larger and the seals are set far apart would require some improvisation to activate the pump.

Figure 2:
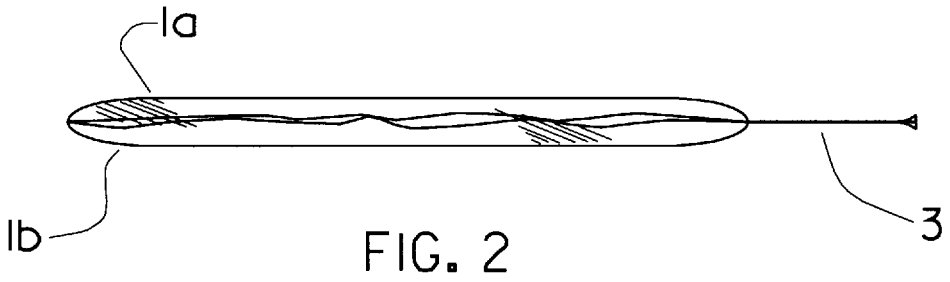
FIG. 2. shows a top view with the pump chamber sleeve expanded outward and the one-way valve closed.

FIG. 2. shows a top view with the pump chamber sleeve 1*a* and 1*b* in the outward bowed position, the pump chamber 1*c* expanded and the one-way valve 3 closed.

Figure 3:
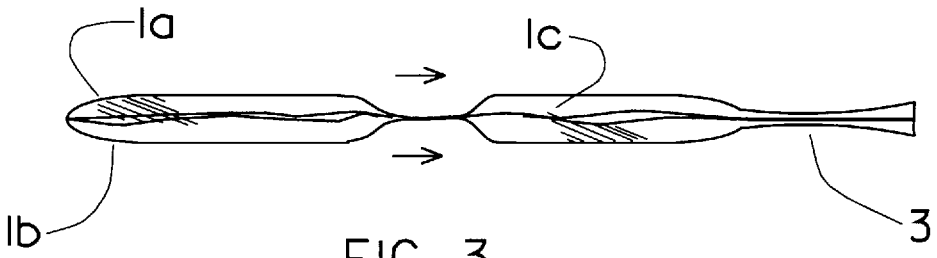
FIG. 3. Shows a top view with the pump chamber undergoing compression and the one way valve opened.

FIG. 3. shows a top view with the pump chamber sleeve 1*a* and 1*b* undergoing compression causing the pump chamber 1*c* to push air and other gases out through the one-way valve 3.

Figure 4:
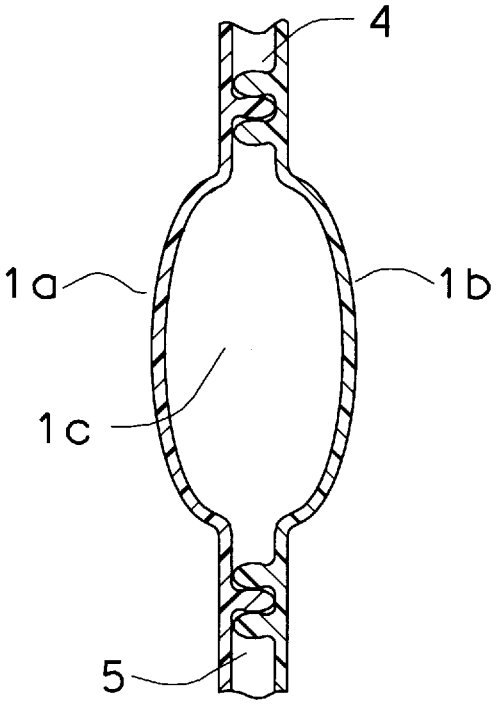
FIG. 4. shows a section view with the pump chamber opened.

FIG. 4. shows a section view with the interlocking seals 4 and 5 engaged and the pump chamber sleeve 1*a* and 1*b* in the outward bowed position forming the pump chamber 1*c* which is opened.

Figure 5:
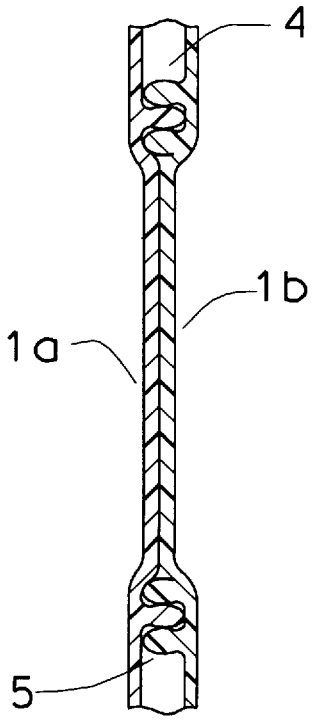
FIG. 5. shows a section view with the pump chamber undergoing compression.

FIG. 5. shows a section view with the interlocking seals 4 and 5 closed and the pump chamber sleeve 1*a* and 1*b* undergoing compression causing air and other gases to be pushed out through the one-way valve 3 as shown in FIG. 3.

We claim:

1. A flexible air tight sealing type storage bag having a storage compartment therein, wherein the improvements comprise:

a pump chamber defined by a pump chamber sleeve made of plastic or other flexible type material incorporated between at least one upper seal and one lower seal which maintains an outward bowed shape except when compressed, a suction port located towards one end of the lower seal permitting air and other gases to flow from the storage compartment into the pump chamber, a one-way valve located at the end opposite the suction port and made of plastic or other flexible type material and which valve is formed when the upper and lower seals are engaged and which valve is designed to open only when the pump chamber is compressed, and the pump chamber which is formed when the upper and lower seals are engaged.

* * * * *